US005888596A

United States Patent [19]

Zinbarg et al.

[11] Patent Number: 5,888,596

[45] **Date of Patent: *Mar. 30, 1999**

[54] GHOST-LIKE DECORATIVE OBJECT

[75] Inventors: Benson Zinbarg; Nancy Mimoun, both of Stamford, Conn.; Alfred Pisano, New York, N.Y.

[73] Assignee: Sun Hill Industries, Inc., Stamford, Conn.

[ * ] Notice: The term of this patent shall not extend beyond the expiration date of Pat. No. 5,672,396.

[21] Appl. No.: 898,334

[22] Filed: Jul. 22, 1997

Related U.S. Application Data

[62] Division of Ser. No. 131,020, Oct. 4, 1993, Pat. No. 5,672,396, which is a continuation of Ser. No. 774,420, Oct. 10, 1991, abandoned, which is a continuation-in-part of Ser. No. 664,024, Mar. 4, 1991, abandoned.

[51] Int. Cl.[6] ..... A63H 27/00

[52] U.S. Cl. ..... 428/16; 428/12; 446/27; 446/28; 446/220; 446/221; 446/222; 446/223; 446/224; 446/225; 446/226; 446/363; D6/597; D6/598; D6/599; D6/604; D9/305; D9/311; D21/84

[58] Field of Search ..... 428/12, 16; D6/597, D6/598, 599, 602, 603, 604; D9/305, 311; D21/84; 446/27, 28, 222, 221, 220, 223, 224, 225, 226, 363

[56] References Cited

U.S. PATENT DOCUMENTS

| | | | |
|---|---|---|---|
| D. 310,023 | 8/1990 | Dembiczak et al. | 446/220 |
| D. 317,254 | 6/1991 | Dembiczak et al. | D9/305 |
| 721,948 | 3/1903 | Gay | 446/224 |
| 3,195,265 | 7/1965 | Marquez et al. | 446/73 |
| 4,174,059 | 11/1979 | Maunder | 224/209 |
| 4,580,372 | 4/1986 | Osborn | 428/131 |
| 4,888,836 | 12/1989 | Calderwood | 428/131 |
| 5,016,848 | 5/1991 | Metz | 446/220 |
| 5,027,457 | 7/1991 | Sweet | 446/390 |
| 5,030,162 | 7/1991 | Hall et al. | 446/363 |
| 5,096,453 | 3/1992 | Van Meter | 446/73 |
| 5,135,222 | 8/1992 | Spector | 446/220 |

FOREIGN PATENT DOCUMENTS

| | | | |
|---|---|---|---|
| 340744 | 7/1904 | France | 446/223 |
| 605558 | 5/1926 | France . | |
| 810660 | 3/1937 | France . | |

OTHER PUBLICATIONS

The Law Works, Jun, 1994, The Death of a Double Standard: Means Plus Function Claim Interpretation in the U.S. PTO After in re Donaldson, Co., Inc.

*Primary Examiner*—Nasser Ahmad
*Attorney, Agent, or Firm*—Frishauf, Holtz, Goodman, Langer & Chick

[57] ABSTRACT

Decorative structures comprising a flexible sheet-like member simulate universal conceptions of the appearance of floating and fixed ghosts. A structure for simulating a universal conception of the appearance of a floating ghost comprises a flexible sheet-like member draped over a support member, such as a balloon, to form a composite structure. The composite structure is suspended from a support structure to simulate the appearance of a floating ghost. A decorative structure for simulating a universal conception of a fixed ghost comprises a support bag member having a filling therein, and a flexible sheet-like member placed over the support bag member and having facial indicia simulating an appearance of a face of a ghost thereon. The free ends of the sheet-like member are secured to the ground at spaced apart positions, to provide a generally inverted conical shape, so that the resultant structure can flutter when subjected to wind or the like. The support bag member may be fixed to the ground, for example, by means of pegs. Another embodiment comprises a pair of balloons tied together to form a reduced size area therebetween. A flexible sheet-like covering member is mounted over the tied-together balloons and is pinched or gathered at the reduced size area between the balloons, by a flexible tie, to simulate a head and body of a ghost-like object.

24 Claims, 5 Drawing Sheets

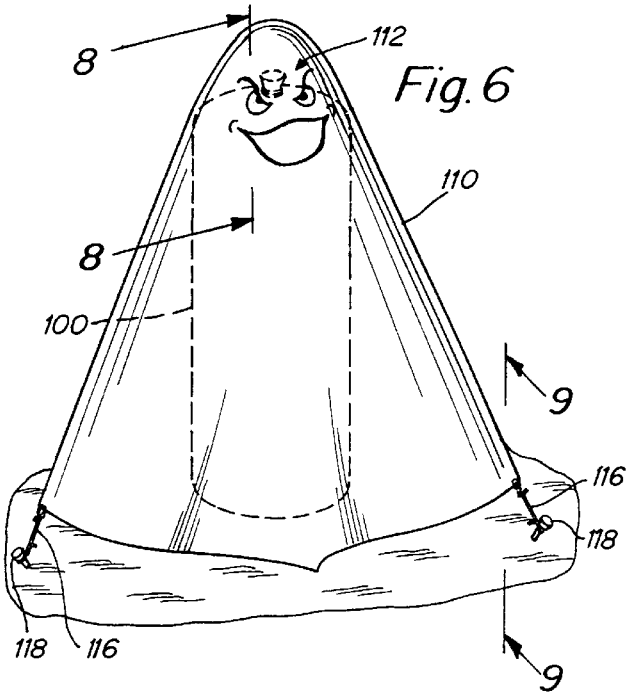
Fig. 6
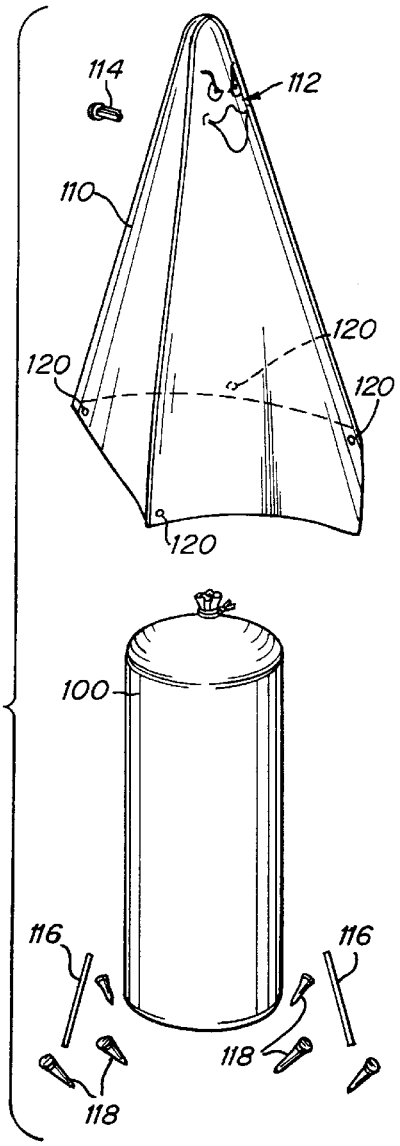
Fig. 7
Fig. 8
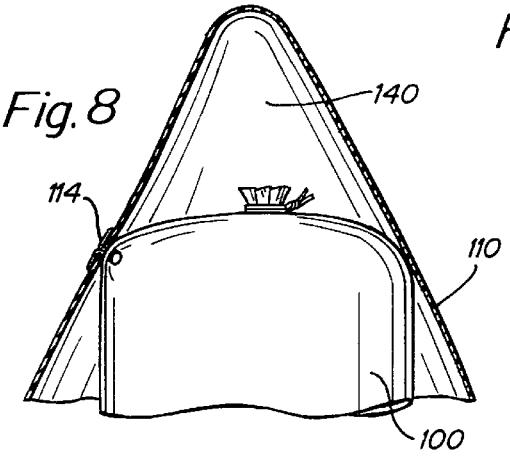
Fig. 9A
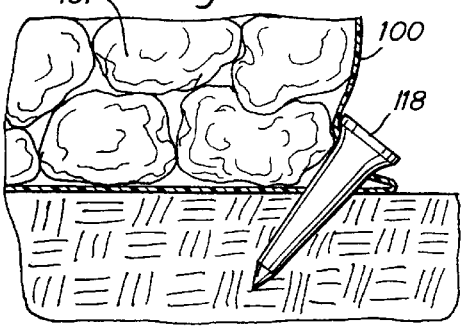
Fig. 9B
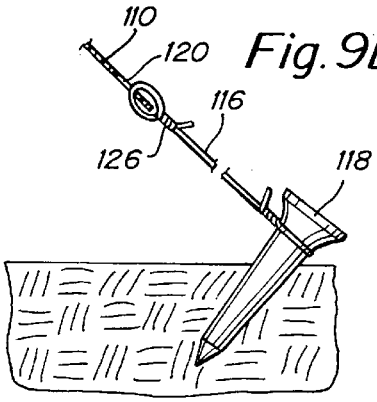

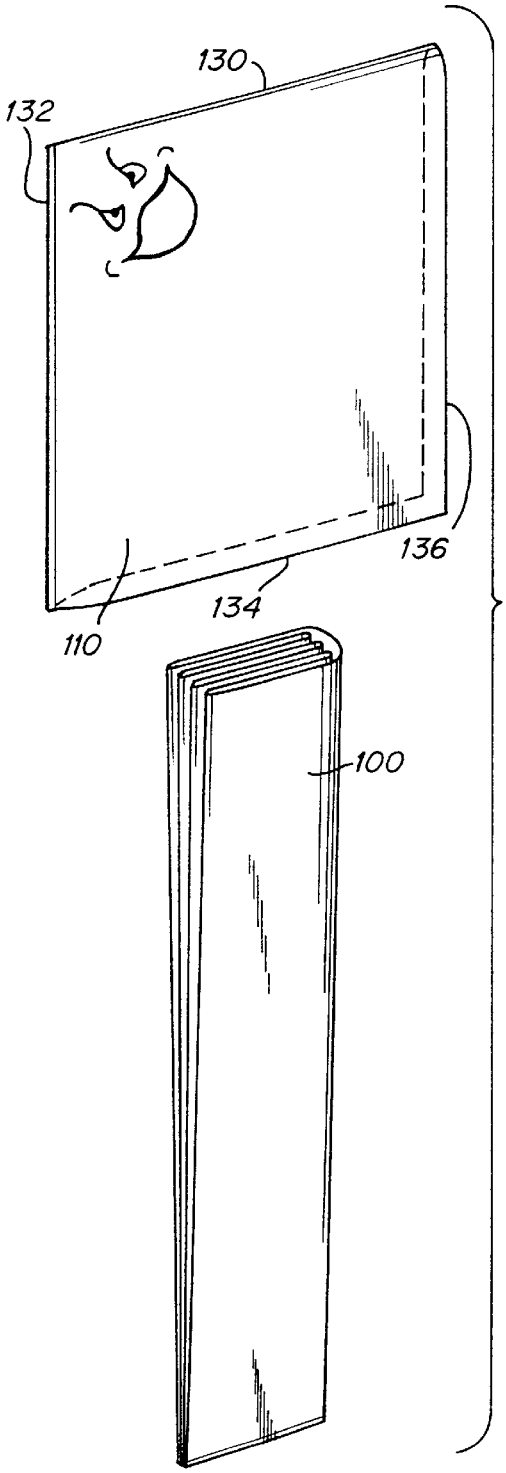
Fig. 10
Fig. 11
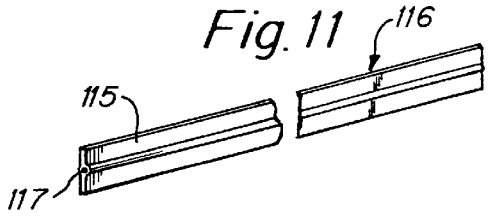
Fig. 12
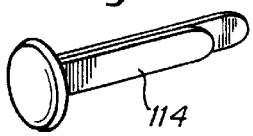
Fig. 13
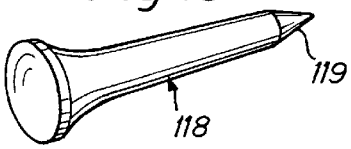
Fig. 14
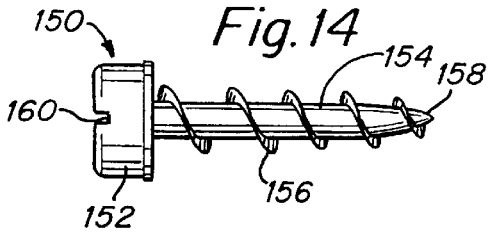
Fig. 15
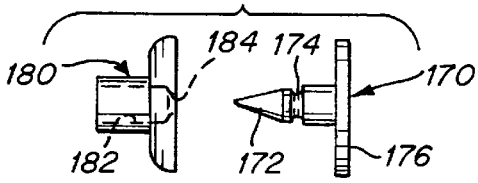

GHOST-LIKE DECORATIVE OBJECT

CROSS REFERENCE TO RELATED APPLICATION

This application is a Division, of application Ser. No. 08/131,020, filed Oct. 4, 1993 now U.S. Pat. No. 5,672,396 which is a Continuation of Ser. No. 07/774,420, filed Oct. 10, 1991, now abandoned which is a Continuation-In-Part of Application Ser. No. 07/664,024, filed Mar. 4, 1991 (now abandoned).

BACKGROUND OF THE INVENTION

The invention relates to ghost-like decorative objects, and more particularly to ghost-like decorative objects which simulate or otherwise represent the universal image or conception of the appearance of a ghost, i.e., what is generally thought to be what a ghost "looks" like. Such decorative objects are referred to hereinafter as "ghost-like" objects, "ghost-like decorative objects" or other similar terminology.

At certain times of the year, for example at Halloween, ghost-like decorative objects are very popular and are strongly associated with the season. Also, at certain times of the year, for example in the fall season, many leaves are on the ground and home owners often rake their leaves and dispose of them in relatively large leaf bags. Except for a relatively new type of leaf bag which has recently been sold during the Halloween season to represent or simulate a pumpkin, the known leaf bags are ordinary leaf bags with no particular significance and with no particular decorative value.

An object of the present invention is to provide a ghost-like decorative object for use on a front lawn or the like which utilizes a large bag, such as a leaf-type bag, for its basic support structure.

A further object of the present invention is to provide a simple, easy-to-manufacture, easy-to-use floating ghost-like decorative object for use either indoors or outdoors, as desired.

SUMMARY OF THE INVENTION

According to one aspect of the invention, a decorative object simulating a universal conception of the appearance of a "floating" ghost comprises a flexible sheet-like member having facial indicia thereon simulating an appearance of a face of a ghost-like object; a bulbous-shaped member on which said flexible sheet-like member is mounted to form a composite structure, with said facial indicia being located in the vicinity of said bulbous member after said sheet-like member is mounted thereon; and support means coupled to at least one of said bulbous member and said sheet-like member for suspending the composite structure to thereby provide a floating ghost-like structure simulating a universal conception of the appearance of a ghost.

According to another aspect of the invention a decorative structure simulating a universal conception of the appearance of a ghost comprises a support bag member having a filling therein; a flexible sheet-like member adapted to be placed over said support bag member, and having facial indicia simulating an appearance of a face of a ghost thereon; and means for securing free ends of said sheet-like member to a support surface after placing said sheet-like member over said support bag member.

According to another aspect, the invention comprises a kit of parts for making the above-described decorative objects.

BRIEF DESCRIPTION OF THE DRAWINGS

FIG. 6 is a perspective view showing another embodiment of the present invention;

FIG. 7 is an exploded view showing the components of the embodiment of FIG. 7 in separated form;

FIG. 8 shows a detail of the embodiment of FIG. 6;

FIGS. 9A and 9B show details of the means for securing the embodiment of FIG. 6 to the ground;

FIG. 10 shows the elements of the embodiment of FIG. 6 in their unassembled state;

FIG. 11 shows a twist tie for use in the present invention;

FIG. 12 shows a clip for use in connecting together the members of FIG. 6;

FIG. 13 illustrates a peg for use in connecting the structure of FIG. 6 to the ground or the like;

FIG. 14 illustrates a stake for use in place of the peg of FIG. 13, for connecting the structure to the ground or the like;

FIG. 15 illustrates a tack and connector structure for use in place of the clip of FIG. 12 for connecting together the members of FIG. 6;

DETAILED DESCRIPTION

Figure 1:
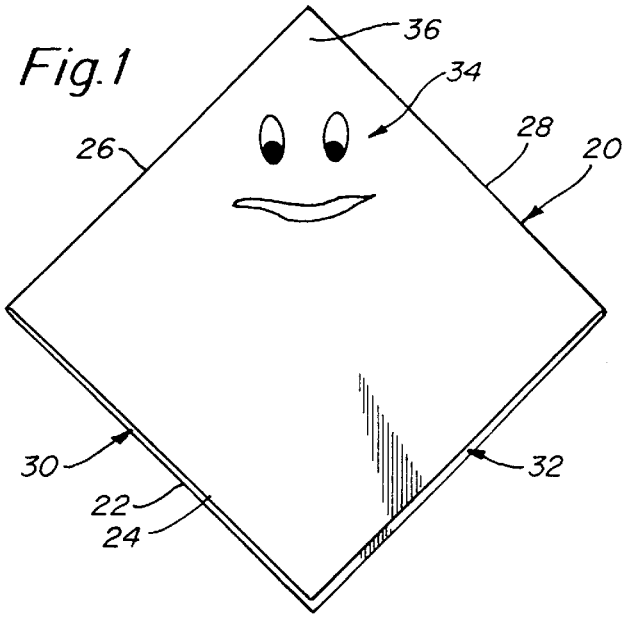
FIG. 1 shows a flexible sheet-like member having a "ghost-like face" imprinted thereon and forming part of the structure of a floating-type ghost-like decorative object, according to a first embodiment of the present invention.

FIG. 1 shows a first element of a floating-type ghost-like object according to the first embodiment of the present invention. The sheet-like member 20 of FIG. 1 comprises two sheet-like portions 22, 24 (front and rear) which are connected together along edges 26, 28, and which are opened along edge portions 30, 32, as shown in FIG. 1. The sheet-like portions are preferably thin, white, flexible plastic material of the type generally used for plastic bags such as leaf or garbage bags. However, a white fabric member may also be used. One or both of the sheet portions 22, 24 has facial indicia 34 thereon which represents or simulates a ghost-like object (i.e. what one thinks a ghost looks like or should look like). The facial indicia 34 on sheet portion 24 is shown in FIG. 1, but it should be clear that a similar (or different) facial indicia is on the opposite side (facing into the page of sheet portion 22), if desired.

Figure 2:
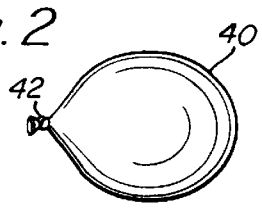
FIG. 2 illustrates an inflated balloon, knotted at one end, and which is adapted to be used with the sheet-like member of FIG. 1 to form a floating-type ghost-like decorative object.
Figure 3:
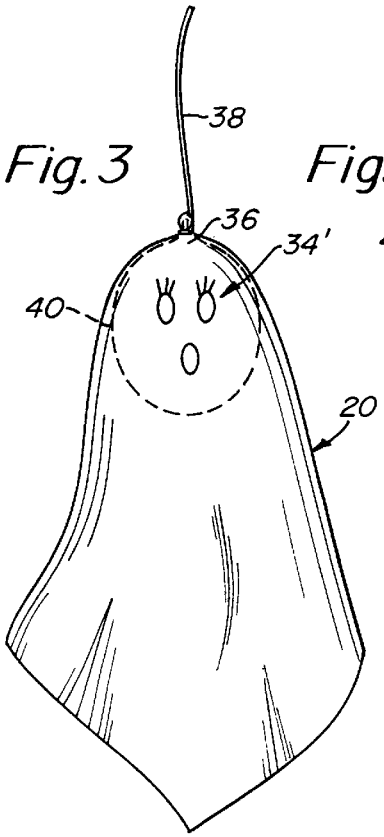
FIG. 3 is an assembled ghost-like decorative object incorporating the sheet-like member of FIG. 1 and the balloon member of FIG. 2.

An inflated balloon 40 of FIG. 2, which is knotted at its end 42 as shown in FIG. 2, is inserted through the open edges 30, 32, of the sheet portions 22, 24 and is placed into the upper corner 36 of the sheet-like member 20 to fill the upper corner thereof, for example as shown in FIG. 3. FIG. 3 shows the ghost-like floating object in assembled form wherein the knotted portion 42 of the balloon 40 is placed in the vicinity of the upper corner 36 of the sheet-like member 20, and a flexible "tie" 38, such as a metal or plastic tie, string or other elongated object, is used to tie the sheet-like member 20 in the vicinity of corner portion 36 to the knotted portion 42 of the balloon to secure the members together. The free end of the tie 38 may then be connected to an object to suspend the ghost-like decorative object so that it appears to be "floating" in space. The free remote end of the tie 38 may be connected to a ceiling, structural member of a house, a piece of furniture, a picture hook, or any other accessible member from which to hang same. Since the weight of the assembled ghost-like decorative object of FIG. 3 is relatively light, it is not necessary to provide a very strong support structure from which to hang same. When used outdoors, the tie 38 can be secured to a tree, post, house structural member such as a porch or the like, or any other object which will accommodate the ghost-like member. When used outside, the ghost-like decorative object will "float" and will flutter and sway in the wind so as to further improve simulation of the universal image or conception of the appearance of a ghost. If the balloon is inflated with a lighter-than-air gas such as helium, the structure can be self-floating or levitating, especially when the sheet-like member 20 is made of thin light weight plastic film material.

Figure 4:
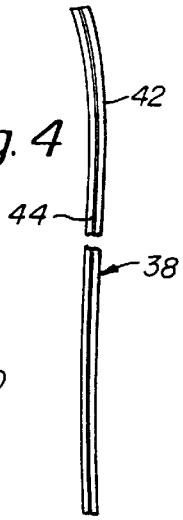
FIG. 4 illustrates an elongated tie member, in enlarged view, for use in hanging the ghost-like decorative object of the present invention to produce a "floating" effect.

FIG. 4 shows a tie 38 which is in the form of an elongated flexible paper or plastic member 42 having a thin flexible metal wire 44 or the like embedded therein, such as a generally known "twist tie" for closing an open end of a plastic bag. The twist tie 38 of FIG. 4 is preferably very flexible for ease of use and should preferably be thin so as to be unobtrusive in use, so that the structure appears to be "floating" in air. As mentioned above, a string, rope or other elongated flexible member may be used in place of tie 38 to suspend the ghost-like object to create a "floating" effect. Clear nylon string, such as that used for fishing may also be used to enhance the "floating" appearance.

The sheet-like member 20 in FIG. 1 is shown as two sheet portions connected together at edges 26 and 28. The interconnection between the sheet portions may be by means of heat sealing or the like. One of the connections 26, 28 may merely be a fold line of a single elongated sheet, and after the sheet is folded along the fold line (for example at fold line 28 in FIG. 1), the other interconnection (for example 26) is made by heat sealing. The upper corner portion 36 is shown as pointed due to the folding and sealing of member 20. It could, however, be rounded or any other shape which could be imparted by heat sealing and tearing off of the excess corner material at the seal.

Figure 5:
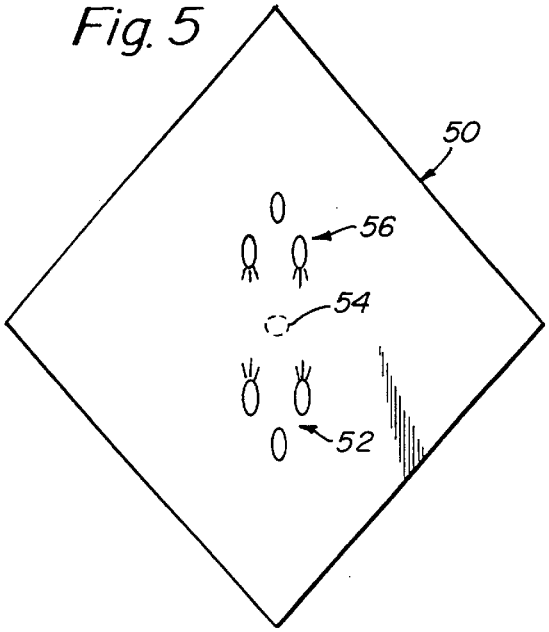
FIG. 5 shows a modified outer covering member of the first embodiment of the present invention.

An alternative embodiment is shown in FIG. 5, wherein the outer covering of the floating ghost-like decorative object is a single sheet-like member 50 preferably having facial indicia 52 thereon, as shown in FIG. 5. Sheet 50 is preferably of the same material as sheet 20 described above. In use, the sheet-like member 50 of FIG. 5 is draped over an inflated balloon (such as the balloon 40 of FIG. 2) and the knotted portion 42 of the balloon is placed in the vicinity of marker 54. Then the "tie" 38 is tied around the portion 54 and the knotted portion 42 of the balloon to interconnect the outer covering 50 with the balloon and the free end of the tie 38 is used to suspend same in the manner of the embodiment shown in FIGS. 1–3. In this alternative embodiment of FIG. 5, the sheet-like member 50 drapes over the balloon and provides a very similar appearance to the structure of FIG. 3. As with the embodiment of FIG. 3, additional facial indicias may be provided on the opposite side of the marker 54, as shown in FIG. 5, so that facial indicia will appear at more than one location around the ghost-like decorative object when in use. Such additional facial indicia is shown at 56 in FIG. 5 by way of example.

While decorative facial indicia is shown as being already applied to the sheet-like members 20 and 50 of FIGS. 1 and 5 respectively, the facial indicia could be applied by the user. In such a case, a stick-on set of facial indicia could be provided in a kit, and the user could adhere same to the sheet-like member, as desired, to create personalized ghost-like members. Alternatively, the facial indicia can be drawn on by hand, using a marker pen, paint, or the like.

While a balloon is shown as member 40 for providing the upper support and upper shaping for the resulting ghost-like structure, it should be clear that any other type of bulbous or round or oval or similarly shaped member can be used. For example, a foam-type member can be used, or a rubber ball or plastic ball or any other type of suitably shaped object could be used, as required. Also, a smaller plastic or paper bag, filled for example with a filling such as crumpled newspapers, can be used in place of the balloon.

Still further, the upper portion of the sheet-like member 20, 50, instead of being tied to the upper portion of the balloon, may have an opening therein (such as shown by the dashed lines 54 in FIG. 5) through which a knot of a balloon or a connecting member of any other type of support member could be passed for connection to a tie 38 or the like for supporting the structure in a floating manner.

In the embodiment of FIGS. 1–3, typical (but not limiting) dimensions are:

1. Sizes of rectangle or sheets 22, 24: 30"×30"; or 36×34"; or any other desired size
2. Thickness of sheet 20:
3. Material of sheet 20:
4. Color of sheet 20: white with black facial indicia
5. Diameter of inflated balloon: about 6 inches to about 12 inches. The above dimensions are only by way of example, and are not limiting.

FIG. 6 shows a second embodiment of a ghost-like structural arrangement which is adapted to be used in a fixed position, for example on the lawn or outside area of a house of a user. The ghost-like structure shown in FIG. 6 comprises a support member 100 which may take the shape of a bag-like structure which is filled with leaves, crumpled newspaper or other waste materials, as desired. The bag 100 is shown as an elongated tubular shaped bag in FIG. 6. It could take other shapes, such as rounded, but an upright tubular bag as shown in FIG. 6 is preferred. After filling of the elongated tubular bag member 100, the bag 100 is tied closed at the top (i.e., by a "tie") and is covered by a flexible sheet-like member 110 which is draped thereover, as shown in FIG. 6. The sheet-like member 110 will be described in greater detail hereinbelow.

As shown in FIG. 6, the sheet-like member 110 is preferably white to simulate the appearance of a ghost-like object, and preferably has facial indicia 112 thereon which represents a fanciful or simulated appearance of the face of a ghost-like object. The free lower ends of the sheet-like member 110 are spread to form a generally inverted conical shape and are secured to the ground by means of, for example, twist ties and peg-like members, as will be described in greater detail hereinbelow.

Referring to FIG. 7, the various elements of the invention are shown in their disassembled state. The basic, elements comprise the filled tubular bag 100 (which is sold to the user in a flat unfilled state - see FIG. 10), the sheet-like member 110, spread clips 114, twist ties 116 and pegs 118. The sheet-like member 110 preferably has holes 120 therein at various spaced apart positions around the lower peripheral portions thereof for use in connecting twist ties thereto for anchoring the lower edge portions of the sheet-like member 110 to the ground. The anchoring technique will be described in detail hereinbelow.

FIG. 8 shows a detail taken along section line 8—8 in FIG. 6, showing how the sheet-like member is preferably secured at least one portion thereof to an upper portion of the filled bag 100 by means of a spread clip 114. The clip 114 is preferably a readily available spread clip which is used in offices and which is widely available in stationary and office supply stores. The clip 114 is shown in greater detail in FIG. 12 by way of example. The clip, in its closed state as shown in FIG. 12 is pierced through the outer sheet-like member 110 and an upper portion of the bag 100, after which the free ends of the clip are spread outwardly, as shown in FIG. 8, to secure the sheet-like member 110 and filled bag 100 together. More than one clip may be used at spaced apart portions around the periphery of the upper portion of the bag 100, one clip being shown in FIG. 8 by way of example.

As shown in FIG. 9B, after the sheet-like member is secured to the upper portion of the bag 100, the lower free ends or "shirt tails" of the outer sheet-like member 110 are secured to the ground at spaced apart portions around the periphery thereof, with the outer sheet-like member being preferably in the form of an inverted conical shape, as shown in FIG. 6. FIG. 9B shows a twist tie 116 which passes through a hole 120 in the lower portion of the sheet-like member 110, and which has an end wrapped around itself at 126 to secure itself to the lower portion of the sheet-like member 110. The opposite end of the tie 116 is wrapped around or otherwise connected to a peg 118, as shown for example in FIG. 9B, and the peg is pushed into the ground, as shown in FIG. 9B. This interconnection to the ground is shown schematically in FIG. 6 at spaced apart portions around is the periphery of the lower edge of the sheet-like member 110. By anchoring the sheet-like member 110 to the ground as shown, sufficient support is provided to keep the ghost-like member from toppling over, while also allowing the sheet to "flutter" in the wind, creating an eerie, ghost-like effect. Instead of using ties 116, the free ends of the sheet-like member may be directly pegged to the ground, but the technique of using the tie between the sheet and the peg is preferable. String, wire or the like can be used in place of the ties 116.

In order to further anchor the structure to the ground, pegs 118 are pierced through the lower portions of the bag 100 at spaced apart portions around the periphery of the lower portion of the bag 100, anchoring the bag per se to the ground, as shown in FIG. 9A. This further improves the structural integrity of the resulting structure.

As shown in FIG. 8, the upper portion of sheet-like member 110, in the vicinity of the facial indicia, extends above the upper portion of the support bag 100 so as to provide a free hollow space 140 therebetween (see FIG. 8). This free hollow space 140 provides room for the upper portion of the sheet-like member 110 to "flutter" and to be movable so as to further simulate the eerie appearance of a ghost.

The support bag 100 may be filled with leaves or crumpled newspapers, or any other waste materials or other non-waste materials suitable for filling a garbage-type or leaf-type bag. FIG. 9A shows the filling material 101 as large particles, for example, as crumpled newspapers. It should be clear that any type of filling material can be used. Crumpled newspapers or leaves, however, are desirable since they are usually readily available and in want of being disposed. Further, crumpled newspapers or leaves provide a relatively large amount of filling with a relatively large amount of air space between particles thereof, thus not overly increasing the weight of the resulting structure.

The sheet-like member 110 may be a member folded over and sealed at one edge, as shown in FIG. 10. In FIG. 10, the upper edge 130 of the outer sheet-like member is folded over, and the left-side edge is heat sealed together. The edge portions 134, 136 are opened for passing over the supporting bag 100. Alternatively, a single unfolded sheet-like member, such as the sheet member 50, shown in FIG. 5, may be used to be draped over the bag 100. The sheet member 50, of course, must be suitably sized to fit over bag 100 with suitable draping and with sufficient material to permit extending same into a generally inverted conical shape as shown in FIG. 6 so as to permit fluttering and to create a more realistic ghost-like object. In FIG. 10, the supporting bag 100 is shown in its flat, folded state, before filling thereof.

FIG. 11 shows a generally well known twist tie similar to that of FIG. 4, which has a plastic or paper-like wide portion 115 (which is flexible) and a wire member 117 embedded therein or connected thereto, to permit positive tying, twisting or the like of the tie member 116. The peg 118 of FIG. 13 may be any type of peg with a pointed end 119 which can easily pierce the ground, and may, for example, be a golf tee, which is readily available.

FIG. 14 illustrates a screw-threaded-type stake member 150 which can replace the peg or tee 118 of FIG. 13 for securing the apparatus to the ground. The member 150 has a head portion 152 and a shaft or shank portion 154 with threads (similar to screw threads 156) thereon. The shank portion 154 is provided with a generally pointed end 158 for ease of insertion into the ground or the like. In use, the user pierces the plastic bag material with pointed end 158 and applies pressure on the head 152 so that the pointed end 158 begins to penetrate the ground or the like. Then, the head 152 is either pressed straight into the ground (if it is soft enough) or it is turned by hand, or a coin or the like is inserted into the coin or screw driver slot 160 to turn the stake 150, to "screw" it into the ground or the like. The stake 150 can be molded from plastic material (i.e., polypropylene) by injection molding or may be otherwise formed.

FIG. 15 shows a tack structure which can replace the spread clip 114 shown in FIG. 12. The tack structure of FIG. 15 comprises a push-tack 170 having a pointed shank member 172 with a recess 174 therein. A receptacle 180 is provided which has an elongated opening 182 therein with a reduced cross-sectional opening portion 184 at the front end thereof. In use, the plastic parts to be tacked together or clipped together are held by the user, the tack member 170 is pushed therethrough beginning with the pointed end 172 by applying pressure to the head end 176, and the receptacle member 180 is placed behind the tack and the pointed end 172 of tack member 170 is pushed into the opening 182 of the receptacle member and the reduced diameter portion 184 "snaps" into the reduced diameter section of shank 172 to "snappingly lock" thereon, and to hold the clipped plastic parts together. The snap action engagement is obtained by virtue of the resiliency of the plastic material from which the receptacle 180 are made, for example polypropylene or other suitable injection moldable plastic material.

Various other devices can be used in place of the stake of FIG. 14 and the tack structure of FIG. 15, as desired.

Preferably, the ghost-like decorative object of the present invention is sold in kit form. A kit for the ghost-like decorative object of FIGS. 1–5 comprises, for example, at least one main sheet-like member 20, at least one balloon 40, and at least one elongated tie member 38. Preferably, such a kit comprises a plurality of each of said members, so as to produce a plurality of floating ghost-like objects. For example, such a kit may comprise three balloons 40, three different size main sheet-like members 20, so as to produce different size ghost-like decorative objects, and three ties 38 for use with each of the respective "floating ghost-like decorative objects".

A kit for the ghost-like decorative object of FIG. 6 is shown in FIG. 7 and comprises at least one main bag member 100, at least one sheet-like member 110, a plurality of ties 116, a plurality of pegs 118 ( or other stakes), and at least one clip 114 (or tack member of FIG. 15).

Figure 16:
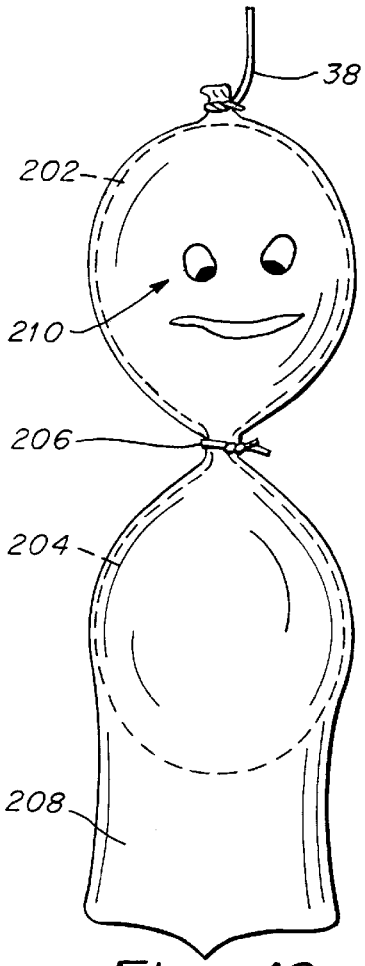
FIG. 16 illustrates another embodiment of the present invention using two balloons.

FIG. 16 shows a further embodiment of the invention using two inflated balloons so as to provide an improved shape for the resulting ghost-like decorative object. The two balloons 202, 204 are connected together for example by means of a flexible "tie" 203 (FIG. 17), similar to the tie 38 described hereinabove with respect to the other embodiments. The interconnected area between the two balloons defines a reduced size area. A substantially flat sheet-like member 208 is draped over the two interconnected balloons, and is tied or pinched in at an intermediate portion (at the reduced size area) by means of tie 206, in order to provide a more realistic ghost-like decorative object as shown in FIG. 16. Facial indicia 210 is provided on the sheet-like member 208 to simulate the appearance of a face of a ghost-like object. The resulting structure is hung by means of a tie 38 similar to the tie described hereinabove. The tie 38 pinches a small amount of the sheet-like member 208 at the top portion thereof, as shown in FIG. 16, to securely hang the ghost-like decorative object.

Figure 17:
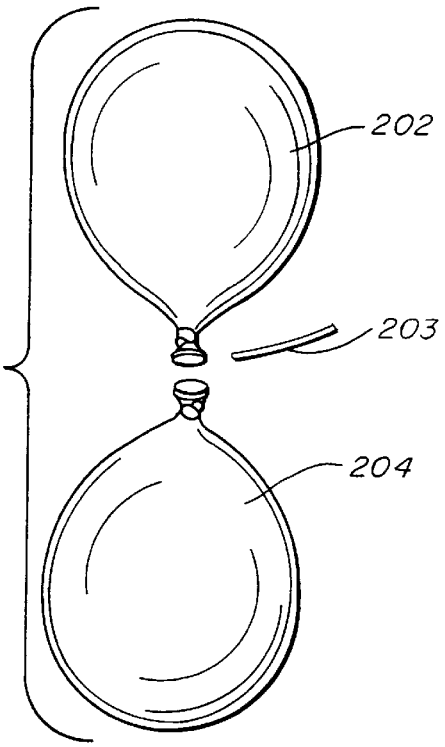
FIG. 17 shows two balloons, inflated, ready to be assembled.

FIG. 17 shows the two balloons 202, 204 in their inflated state, prior to assembly. A tie 203, similar to or identical to tie 38, is used to tie the two balloons together, resulting in the subassembly shown in FIG. 18.

Figure 18:
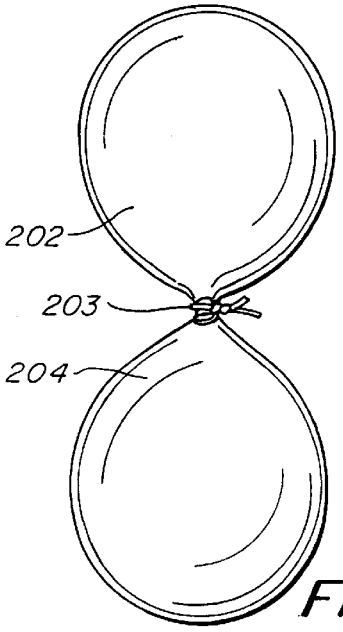
FIG. 18 shows the assembly of the two balloons of FIG. 17.
Figure 19:
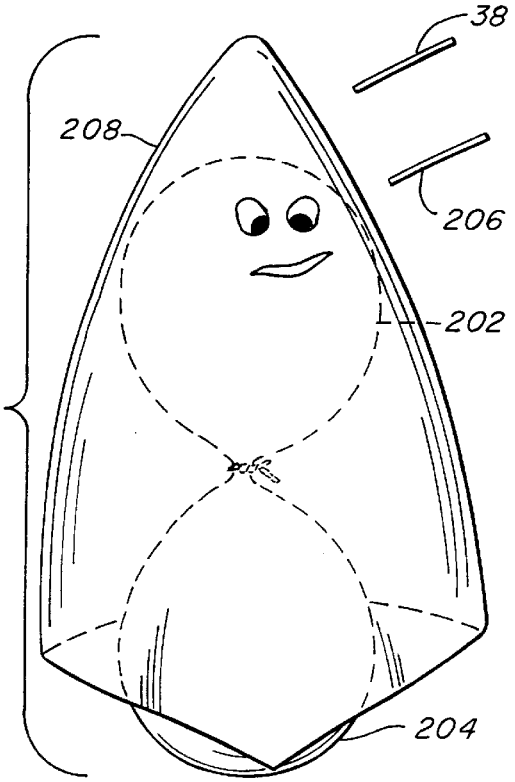
FIG. 19 shows the embodiment of FIG. 16 in its partially assembled state.

FIG. 19 shows the intermediate step of placement of the sheet-like member 208 over the subassembly of FIG. 18. The ties 38, 206 are shown prior to connection thereof. After the sheet-like member 20 is mounted over the subassembly of the two interconnected balloons, the tie 206 is tied around the intermediate reduced size area between the inflated balloons to pinch or gather the outer sheet-like member 208, resulting in the completed configuration shown in FIG. 16. The tie 38 is connected to the upper portion, also as shown in FIG. 16, for hanging from an object. The resulting structure is a more realistic looking ghost-like decorative object as shown in FIG. 16.

Figure 20:
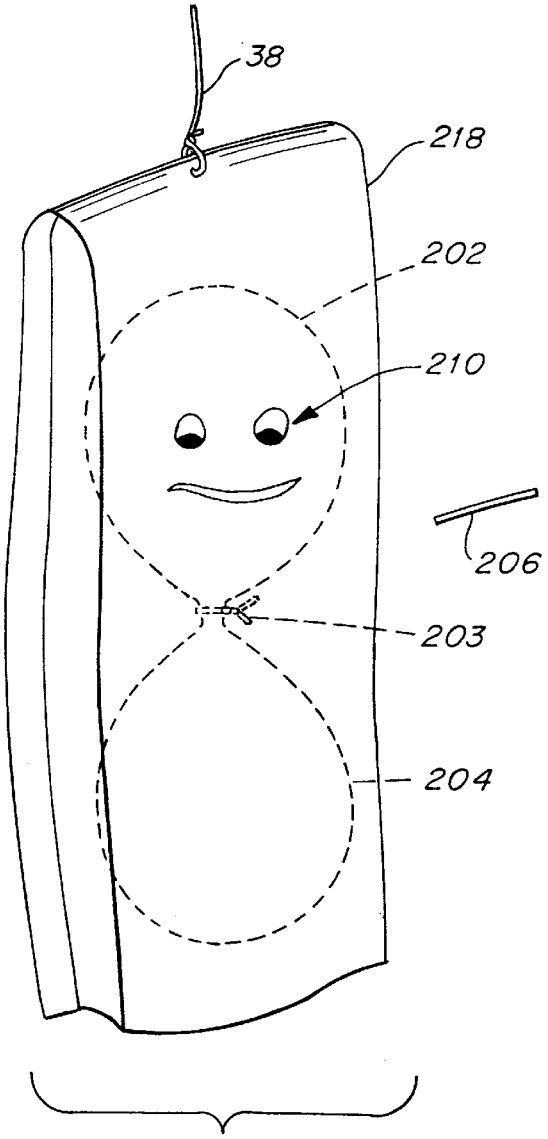
FIG. 20 illustrates another embodiment of the invention, using two balloons, in its partially assembled state.
Figure 21:
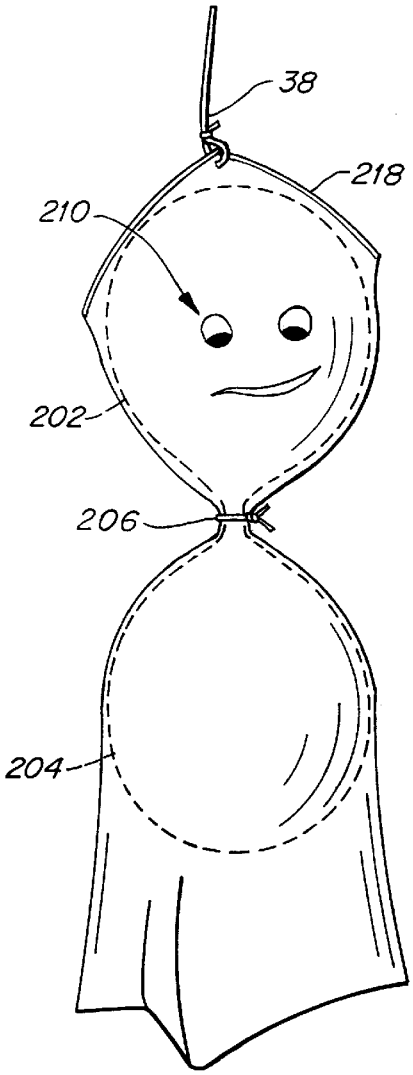
FIG. 21 shows the embodiment of FIG. 20 in its fully assembled state.

FIG. 20 shows a further embodiment of the invention wherein a subassembly of balloons 202, 204 is also used along with the intermediate tie 203 connecting the inflated balloons together. Instead of the substantially flat sheet-like member 208, an inverted flexible bag-like member 218 is used as the outer covering. The outer bag-like member 218 is mounted over the subassembly of the balloons 202, 204, as shown in the intermediate step in FIG. 20. After the bag 218 is fully inserted over the subassembly of the balloons 202, 204, the tie 206 is tied around the overall construction to pinch or gather the bag-like member 218 at the reduced size area intermediate the two balloons, to result in an overall structure of FIG. 21 which looks very much like the embodiment of FIG. 16. Facial indicia 210 is also provided on the bag 218, as shown in FIGS. 20 and 21.

The embodiments of FIGS. 16–21 provide an improved, more realistic-looking ghost-like decorative object, which is easy to manufacture, easy to assemble and which has a relatively long useful life. The resulting shape is improved greatly over the shape of the embodiment of FIG. 1 which uses only one balloon or other bulbous-shaped member.

While the above invention is described by way of illustration with respect to a ghost, other decorative objects simulating other fanciful beings (i.e. imaginary beings) could be exemplified or represented by the invention, for example a devil, vampire, etc. by suitably coloring and decorating the outer surface of outer members 208, 218. However, use of a white outer member 208, 218 provides a realistic-looking appearance of a floating ghost-like decorative object (which is, as defined herein, a fanciful being).

As should be clear, the bottom portion of the resulting configuration, defined by the lower balloon 204, presents the appearance of the body of the resulting decorative object. The balloons 202, 204 may be the same size or may be different sizes. For example, the balloon 204 defining the lower portion (body part) may be larger than the upper balloon 202 which defines the head portion of the decorative object.

The flexible members 208, 218 are preferably made of thin, plastic material, similar to the materials used for the outer covering of the aforementioned embodiments.

While balloons are illustrated as preferred embodiments of the underlying bulbous-shaped members, other members, such as bulbous-shaped foam members or the like could be used in place of the balloons, and may be suitably interconnected together, as required.

More than two balloons can be interconnected together. However, the use of two balloons is particularly convenient since the tied ends of each balloon, after inflation of the respective balloons, can then be used to interconnect the two balloons together in an easy and convenient manner. Thus, two balloons is preferable.

Assembly and use of the kits is as described hereinabove.

While there has been described and illustrated preferred embodiments of the present invention, it is apparent that numerous alterations, additions and omissions made be made without departing from the spirit and scope of the invention as defined in the claims.

What is claimed is:

1. A decorative structure simulating an appearance of a floating ghost, comprising:

a flexible bag member made of a flexible sheet material, and having facial indicia thereon for simulating at least an appearance of a face of a ghost object, said bag member having a closed end portion and peripheral free edge portions at an open end portion thereof;

a filling material in the closed end portion of said bag member and over which said flexible sheet material is mounted with said sheet material in contact with said filling material to provide a composite structure of said bag member and said filling material therein, with a portion of said bag member having said facial indicia thereon being located adjacent to and in contact with said filling material, said flexible sheet material of said bag member being draped completely over and in contact with said filling material in said bag member such that said flexible sheet material completely covers said filling material and the entire peripheral free edge portions of said bag member are unsupported and freely hang down, said entire peripheral free edge portions hanging a distance below said filling material and being freely movable, without constraint, relative to said filling material; and a flexible elongated support member having a lower end portion fixedly coupled to an upper closed end portion of said bag member for suspending said composite structure to an object which is located above said composite structure, said flexible elongated support member extending upwardly from said upper closed end portion of said bag member, and said flexible elongated support member having an upper end portion which is fixedly coupled to a support object located above said composite structure for suspending said composite structure to said support object and for supporting said composite structure to hang down from said support object at a distance below said support object such that said composite structure is freely movable relative to said support object responsive to air movement and said entire peripheral free edge portions of said bag member are freely movable relative to said filled closed end portion of said bag member responsive to said air movement, to thereby provide a floating ghost structure simulating the appearance of a floating ghost.

2. The decorative structure of claim 1 further comprising a tie member for gathering said bag member at a position below said filling material to define a pinched in or gathered bag portion and to cause the filled closed end portion of said bag member to have a substantially curved shape.

3. A decorative structure according to claim 2, wherein said filled closed end portion of said bag member has a substantially round shape.

4. A decorative structure according to claim 2, wherein said filled closed end portion of said bag member has a substantially oval shape.

5. The decorative structure of claim 2, wherein said pinched in or gathered bag portion comprises a neck portion of the fanciful being.

6. A decorative structure simulating an appearance of a floating ghost, comprising:

a flexible bag member made of a flexible sheet material, and having facial indicia thereon for simulating at least an appearance of a face of a ghost object, said bag member having a closed end portion and peripheral free edge portions at an open end portion thereof;

a pair of filled portions in said bag member, each filled portion being filled with a filling material and the filled portions being located one above the other with a reduced size area formed therebetween, an uppermost filled bag portion being at said closed end portion of said bag member, said reduced size area being smaller than a maximum horizontal cross-sectional dimension of said filled bag portions, said flexible sheet material being in contact with said filling material to provide a composite structure of said bag member and said filling material therein, with a portion of said bag member having said facial indicia thereon being located adjacent to and in contact with filling material in said uppermost filled portion of said bag member, each of said filled bag portions having curved outer surfaces;

a gathering member for gathering said flexible sheet material of said bag member at said reduced size area to define a head and body of the ghost object respectively above and below said reduced size area, said head of the ghost object being defined by said uppermost filled portion at said closed end portion of said bag member;

the entire peripheral free edge portions of said flexible sheet material being unsupported and freely hanging down below the lower filled bag portion a distance below said lower filled bag portion, so that the entire peripheral free edge portions are freely movable, without constraint, relative to said filled bag portions; and a flexible elongated support member having a lower end portion coupled to at least an upper closed end portion of said bag member for suspending said composite structure to an object which is located above said composite structure, and for supporting said composite structure to hang down from said support object, said flexible elongated support member extending upwardly from said uppermost filled bag portion, said flexible elongated support member having an upper end portion which is arranged such that said composite structure hangs down at a distance below said support object and is freely movable relative to said support object responsive to air movement and said entire peripheral free edge portions of said bag member are freely movable relative to said filled bag portions responsive to said air movement, to thereby provide a floating ghost structure simulating the appearance of a floating ghost.

7. The decorative structure according to claim 6, wherein said gathering member comprises a tie member.

8. A decorative structure according to claim 7, wherein the uppermost of said filled bag portions has a substantially round shape.

9. A decorative structure according to claim 6, wherein the uppermost of said filled bag portions has a substantially round shape.

10. A decorative structure according to claim 7, wherein the uppermost of said filled bag portions has a substantially oval shape.

11. A decorative structure according to claim 6, wherein the uppermost of said filled bag portions is substantially oval shape.

12. The decorative structure of claim 6, wherein said reduced size area comprises a neck portion of the ghost object.

13. A decorative structure simulating an appearance of a fanciful being comprising:

a flexible bag member made of a flexible sheet material, and having facial indicia thereon for simulating at least an appearance of a face of a fanciful being, said bag member having a closed end portion and peripheral free edge portions at an open end portion thereof;

a pair of filled portions in said bag member, each filled portion being filled with a filling material and the filled portions being located one above the other with a reduced size area formed therebetween, an uppermost filled bag portion being at said closed end portion of said bag member, said reduced size area being smaller than a maximum horizontal cross-sectional dimension of said filled bag portions, said flexible sheet material being in contact with said filling material to provide a composite structure of said bag member and said filling material therein, with a portion of said bag member having said facial indicia thereon being located adjacent to and in contact with filling material in said uppermost filled portion of said bag member, each of said filled bag portions having curved outer surfaces;

a gathering member for gathering said flexible sheet material of said bag member at said reduced size area to define a head and body of the fanciful being respectively above and below said reduced size area, said head of the fanciful being being defined by said uppermost filled portion at said closed end portion of said bag member;

the entire peripheral free edge portions of said flexible sheet material being unsupported and freely hanging down below the lower filled bag portion a distance below said lower filled bag portion, so that the entire peripheral free edge portions are freely movable, without constraint, relative to said filled bag portions; and a flexible elongated support member having a lower end portion coupled to at least an upper closed end portion of said bag member for suspending said composite structure to an object which is located above said composite structure, and for supporting said composite structure to hang down from said support object, said flexible elongated support member extending upwardly from said uppermost filled bag portion, said flexible elongated support member having an upper end portion which is arranged such that said composite structure hangs down at a distance below said support object and is freely movable relative to said support object responsive to air movement and said entire peripheral free edge portions of said bag member are freely movable relative to said filled bag portions responsive to said air movement, to thereby provide a fanciful being structure simulating the appearance of a fanciful being.

14. The decorative structure according to claim 13, wherein said gathering member comprises a tie member.

15. A decorative structure according to claim 14, wherein the uppermost of said filled bag portions has a substantially round shape.

16. A decorative structure according to claim 13, wherein the uppermost of said filled bag portions has a substantially round shape.

17. A decorative structure according to claim 14, wherein the uppermost of said filled bag portions has a substantially oval shape.

18. A decorative structure according to claim 13, wherein the uppermost of said filled bag portions is substantially oval shape.

19. The decorative structure of claim 13, wherein said reduced size area comprises a neck portion of the ghost object.

20. A decorative structure simulating an appearance of a fanciful being, comprising:

a flexible bag member made of a flexible sheet material, and having facial indicia thereon for simulating at least an appearance of a face of a fanciful being, said bag member having a closed end portion and peripheral free edge portions at an open end portion thereof;

a filling material in the closed end portion of said bag member and over which said flexible sheet material is mounted with said sheet material in contact with said filling material to provide a composite structure of said bag member and said filling material therein, with a portion of said bag member having said facial indicia thereon being located adjacent to and in contact with said filling material, said flexible sheet material of said bag member being draped completely over and in contact with said filling material in said bag member such that said flexible sheet material completely covers said filling material and the entire peripheral free edge portions of said bag member are unsupported and freely hang down, said entire peripheral free edge portions hanging a distance below said filling material and being freely movable, without constraint, relative to said filling material; and a flexible elongated support member having a lower end portion fixedly coupled to an upper closed end portion of said bag member for suspending said composite structure to an object which is located above said composite structure, said flexible elongated support member extending upwardly from said upper closed end portion of said bag member, and said flexible elongated support member having an upper end portion which is fixedly coupled to a support object located above said composite structure for suspending said composite structure to said support object and for supporting said composite structure to hang down from said support object at a distance below said support object such that said composite structure is freely movable relative to said support object responsive to air movement and said entire peripheral free edge portions of said bag member are freely movable relative to said filled closed end portion of said bag member responsive to said air movement, to thereby provide a fanciful being structure simulating the appearance of a fanciful being.

21. The decorative structure of claim 20 further comprising a tie member for gathering said bag member at a position below said filling material to define a pinched in or gathered bag portion and to cause the filled closed end portion of said bag member to have a substantially curved shape.

22. A decorative structure according to claim 21, wherein said filled closed end portion of said bag member has a substantially round shape.

23. A decorative structure according to claim 21, wherein said filled closed end portion of said bag member has a substantially oval shape.

24. The decorative structure of claim 21, wherein said pinched in or gathered bag portion comprises a neck portion of the fanciful being.

* * * * *